US011504299B2

(12) United States Patent
Li et al.

(10) Patent No.: US 11,504,299 B2
(45) Date of Patent: Nov. 22, 2022

(54) AUTOMATIC ACUPUNCTURE DEVICE, NEEDLE GADGET AND ACUPUNCTURE METHOD

(71) Applicant: Wellness Allied Inc, Natick, MA (US)

(72) Inventors: Weihui Li, Natick, MA (US); Tao Zhang, Natick, MA (US)

(73) Assignee: WELLNESS ALLIED INC, Natick, MA (US)

( * ) Notice: Subject to any disclaimer, the term of this patent is extended or adjusted under 35 U.S.C. 154(b) by 54 days.

(21) Appl. No.: 17/067,880

(22) Filed: Oct. 12, 2020

(65) Prior Publication Data

US 2021/0022959 A1 Jan. 28, 2021

(51) Int. Cl.
*A61H 39/08* (2006.01)
*A61H 39/00* (2006.01)

(52) U.S. Cl.
CPC ..... *A61H 39/086* (2013.01); *A61H 39/083* (2013.01); *A61H 2039/005* (2013.01); *A61H 2201/1207* (2013.01)

(58) Field of Classification Search
CPC .... A61H 39/08; A61H 39/083; A61H 39/086; A61H 2039/005; A61H 2201/1207
See application file for complete search history.

(56) References Cited

U.S. PATENT DOCUMENTS

| | | | | |
|---|---|---|---|---|
| 6,423,014 | B1 * | 7/2002 | Churchill | A61H 39/08 600/587 |
| 2008/0097505 | A1 * | 4/2008 | Kim | A61H 39/08 606/189 |
| 2016/0361229 | A1 * | 12/2016 | Na | A61N 1/36017 |

FOREIGN PATENT DOCUMENTS

| | | | |
|---|---|---|---|
| CN | 2086142 | U | 10/1991 |
| CN | 201012459 | A | 4/2010 |
| CN | 201692306 | U | 1/2011 |
| CN | 202179694 | U | 4/2012 |
| CN | 103126883 | A | 6/2013 |
| CN | 203208351 | U | 9/2013 |
| CN | 203802802 | U | 9/2014 |
| CN | 204521567 | U | 8/2015 |
| CN | 204910065 | U | 9/2015 |
| CN | 105963132 | A | 9/2016 |
| CN | 206239727 | U | 6/2017 |
| CN | 206508245 | U | 9/2017 |
| CN | 107496164 | A | 12/2017 |

(Continued)

*Primary Examiner* — Todd J Scherbel
(74) *Attorney, Agent, or Firm* — IPro, PLLC

(57) ABSTRACT

An automatic acupuncture device includes: a case; a motor or an electromagnet; a needle driver, configured to move linearly under the force of the motor or electromagnet to drive an acupuncture needle in a needle gadget into a human body, the needle gadget comprising a needle tube and an acupuncture needle inside the needle tube; a needle gadget chamber configured to house the needle gadget; and a locking-releasing structure that is configured to lock the needle gadget so that it will not fall out of the needle gadget chamber during acupuncture treatment, and also configured to release the needle gadget from the needle gadget chamber after acupuncture treatment. A needle gadget is provided for use with the acupuncture device, so that the acupuncture needle will not be exposed in air outside the needle tube before or after acupuncture. The acupuncture process is automatic, safe, without complicated manual operation.

19 Claims, 13 Drawing Sheets

(56) References Cited

FOREIGN PATENT DOCUMENTS

| | | | |
|---|---|---|---|
| CN | 108392412 | A | 8/2018 |
| CN | 108743367 | A | 11/2018 |
| CN | 109125062 | A | 1/2019 |
| CN | 110123629 | A | 8/2019 |
| CN | 108309788 | B | 3/2020 |
| CN | 111150648 | A | 5/2020 |
| KR | 2006095944 | A1 | 9/2006 |

* cited by examiner

AUTOMATIC ACUPUNCTURE DEVICE, NEEDLE GADGET AND ACUPUNCTURE METHOD

TECHNICAL FIELD

The invention generally relates to an automatic acupuncture device, a needle gadget to be used in conjunction with the automatic acupuncture device, and a method to do acupuncture with the automatic acupuncture device.

BACKGROUND

Acupuncture has a history of more than 2000 years in China. Traditional Chinese medicine believes that there is Qi and blood in the human body to keep the basic functions. Acupuncture can regulate the Qi and blood and improve health. On the body, there are also meridians and acupuncture points which are more effective to do acupuncture. During acupuncture, an acupuncturist inserts acupuncture needles into a patient's body with certain angles, uses lifting-thrusting and twisting-rotating acupuncture manipulations to enhance acupuncture effect to treat diseases.

Patients generally see acupuncturists during the daytime for acupuncture treatment. However, according to the acupuncture theory, each meridian has its own active time. Thus, the best time for treatment may be at night or early in the morning. In addition, the onset time of various diseases, such as insomnia, headache, are not limited to the daytime. Therefore, there is an urgent need for an acupuncture device that can be used conveniently at home whenever needed.

In the past, there have been some patents trying to solve this problem.

Patents CN108392412A, CN204521567U, CN204910065U, CN109125062A have designed acupuncture robot systems with mechanical arms. Although they can realize automatic acupuncture function, the designs are complex, the systems are huge, and the prices are high. They are not portable and not suitable for home use.

Patents CN108743367A, KR9600102433Y1, KR20384866Y1, KR201800247777A, TW201012459A, CN108309788B, CN103126883A, WO2006095944A1, CN203208351U, 203802802U and CN201692306U have designed another group of acupuncture device, which are in pen shapes or gun shapes. These acupuncture devices are manual acupuncture needle ejectors. When in use, the user holds the device in hand and press a switch to eject a needle out of a needle barrel built in the acupuncture device. Since this type of acupuncture devices need users' action to insert needles, they are not suitable for patients to use at home for themselves. Moreover, the acupuncture needles are exposed to the air outside of the needle tubes and may cause injury to people.

Patents CN202179694U and CN206508245U are manual acupuncture devices as well. In these designs, an acupuncture needle is packaged with a spring inside a needle tube and the spring is pre-compressed by a movable bolt in the needle tube. When in use, the user puts the needle device against the human body, pulls the movable bolt and allows the spring to extend from its compressed state, which pushes the needle into the human body. This type of acupuncture device needs manual operation and cannot be attached on the body during treatment. In addition, after the use, the needle is exposed outside of the needle tube and can cause injury.

Patent CN2086142U designs another type of acupuncture device with ejection spring for needle insertion and needle clamper for needle holding. When in use, the user needs to load the needle manually and press a button for needle releasing and insertion. This kind of acupuncture device is complex to operate and cannot be made into wearable devices.

Patent CN111150648A presents an automatic acupuncture device which uses negative pressure to drive a piston and push the needle for insertion. The design needs to press the instrument repeatedly to create negative pressure. It is inconvenient to use.

Patent CN107496164A designs an acupuncture device for automatic manipulation. Before use, the user manually loads a needle into the device, manually set the acupuncture depth and other parameters. Then the user powers on the device to insert the needle. The device will do the manipulation automatically. The use of this automatic acupuncture device is complex, and the acupuncture needle may touch with various parts of the acupuncture device directly and can use possible cross contamination.

Patent CN110123629A designs an automatic acupuncture device that allows to choose needles of different sizes. It characterizes with a needle barrel loaded with different sizes of needles in different chambers. A second barrel has an ejector chamber that can align with these different chambers of needles. The insertion of needle itself is manual. This type of device is complex to use and the needles are exposed to the device directly and can cause contamination.

Patents CN105963132A and CN206239727U present an automatic acupuncture system, including a positioning part, a power system, an acupuncture device, and a drone to carry the acupuncture device to the desired body parts, etc. The system is complex and more important, it uses the same acupuncture needle repeatedly, only with spray disinfection.

SUMMARY

In view of the above medical needs and previous inventions, the present invention proposes an automatic acupuncture device that is portable, convenient to use, with the consideration of safety.

According to one aspect of the invention, an automatic acupuncture device is provided, which comprises: a case; a motor or electromagnet that is configured to provide force to move a needle driver linearly after powered on; a needle driver that is configured to move linearly under the force of a motor or electromagnet to push an acupuncture needle in a needle gadget into human body, where the needle gadget includes a needle tube and an acupuncture needle inside the needle tube, the needle tube has a ceiling, a wall and a floor, and the needle gadget is configured to keep the acupuncture needle with the needle tube before, during and after acupuncture treatment, so that the acupuncture needle will not be exposed to air outside of the needle tube to avoid possible injury; a needle gadget chamber that is configured to house the needle gadget, allowing the needle gadget being put into or taken out of the needle gadget chamber detachably; and a locking-releasing structure that is configured to lock the needle gadget in the needle gadget chamber so that the needle gadget will not fall out of the needle gadget chamber during acupuncture treatment, and that is also configured to release the needle gadget from the needle gadget chamber after acupuncture treatment.

Optionally, the automatic acupuncture device further comprises a control circuit, which is configured to control device starting, needle insertion, needle manipulations, needle removing, and/or user interface displaying.

Optionally, the motor is configured as a rotary motor and its motor shaft rotates when powered on, and the motor further comprises a transmission system that converts a rotary motion to a linear motion.

Optionally, the transmission system of the automatic acupuncture device comprises a screw rod connected to the motor shaft; a guide rail mounted on motor shell; a screw nut around the screw rod that slides along the guide rail when the screw rod rotates, to move the needle driver linearly.

Optionally, the motor is configured as a linear motor with a needle driver connected on its motor shaft, when powered on, the motor shaft and the needle driver move linearly.

Optionally, the motor shaft and therefore the needle driver move linearly as well as rotate, which drives the needle to move linearly and to rotate through an uneven surface coupling between the needle driver and the needle top, to perform rotating acupuncture manipulation.

Optionally, the needle driver is a vertical pole, and the needle tube ceiling of the needle gadget has a hole to allow the needle driver entering into the needle tube vertically from the top, getting in touch with the needle top and pushing the needle.

Optionally, the needle driver is a horizontal bar, the needle tube ceiling of the needle gadget has a hole with a diameter wider than the bar, the needle tube wall has a slit with a width wider than the bar, the slit and the hole are connected, and when in use, the needle driver enters the needle tube from the hole and the slit, touches the needle top to move the needle.

Optionally, the needle driver is a horizontal bar, the needle tube wall of the needle gadget has a slit with a width wider than the bar, and when in use, the needle driver enters the needle tube through the slit on the needle tube wall, makes contact with the needle top to move the needle.

Optionally, the automatic acupuncture device further comprises an ejector spring, which is configured as following: when the needle gadget is pushed into the needle gadget chamber, the ejector spring is compressed, and a locking-releasing structure locks the needle gadget in the chamber; when the locking-releasing structure unlocks the needle gadget from the needle gadget chamber, the ejector spring extends and pushes out the needle gadget.

Optionally, the locking-releasing structure comprises a locking head, and the needle tube of the needle gadget has a locking notch, and when the needle gadget is pushed into the needle gadget chamber and the locking head is pressed into the locking notch, the needle gadget is locked in the chamber.

Optionally, the locking-releasing structure is a magnetic piece inside the needle gadget chamber, which attracts ferromagnetic materials attached on the needle tube to lock the needle gadget.

Optionally, the needle gadget chamber has an opening for the needle gadget to enter the chamber, the locking-releasing structure comprises push plates, push rods, connectors on the push plates to connect with the push rods, locking heads protruding into the chamber opening at resting state, sliding rods on which the locking heads move, connector rings on the locking heads to connect with the push rods, push plate springs, the needle gadget is configured to have a locking notch on the needle tube, and the needle gadget chamber, the locking-releasing structure and the needle gadget work together as following: when pushing the needle gadget into the needle gadget chamber opening, the locking heads are pushed out of the chamber opening; meanwhile the push plate springs are compressed until the locking notch is facing the locking heads; the locking heads are then pushed back to the chamber opening by the compressed push plate springs and pressed into the locking notch on the needle tube to lock the needle gadget inside the chamber.

Optionally, the needle gadget chamber has an opening for the needle gadget to enter the chamber, the locking-releasing structure comprises a rotatable frame, a locking head on the frame that protrudes into the chamber opening at resting state, a frame spring, connectors to connect the spring and the frame to the case of the automatic acupuncture device, a press button connected with the frame to rotate the frame and move the locking head, the needle gadget is configured to have a locking notch on the needle tube, and the chamber, the locking-releasing structure and the needle gadget work together as following: when pushing the needle gadget into the needle gadget chamber, the locking head will be pushed out of the chamber opening; at the same time, the rotatable frame is moved and the frame spring is stretched until the locking head is facing the locking notch on the needle tube; the locking head is pulled back into the chamber opening by the frame spring and pressed into the locking notch on the needle tube to lock the needle gadget inside the chamber.

Optionally, the locking-releasing structure comprises a sliding plate, a pull rod, a hook at the tip of the pull rod, a sliding rod on which the sliding plate slides, a spring connecting the sliding plate and the device case, connectors to fix the two ends of the spring, a locking head, connectors to connect the locking head to the sliding plate, an elevating groove, a falling groove and a notch island on the sliding plate, a notch on the notch island for the hook to hook on, a guiding peninsula, wherein the elevating groove becomes shallower towards the notch island, and the notch becomes deeper again at the end of elevating groove, and the locking-releasing structure works as following: when the needle gadget is pushed into the needle gadget chamber for the first time, the sliding plate and the locking head are pushed in; the hook slides towards the notch island along the elevating groove; when the needle gadget reaches the bottom of the chamber, the hook reaches the end of the elevating groove, falls into the deep notch on the notch island and gets hooked on the notch; at the same time, the locking head is pressed into a locking notch on the needle tube, locks the needle gadget in the needle gadget chamber and the spring is stretched; when the pushing force is released from the needle gadget, the needle gadget stays in the needle gadget chamber and is ready for acupuncture treatment; when needle gadget is pushed again after acupuncture treatment, the hook is released from the notch and guided into the falling groove; at the same time, the stretched spring pulls the sliding plate back towards the opening of the needle gadget chamber, releases the locking head from the locking notch, and pulls the needle gadget out of the needle gadget chamber.

Optionally, the needle driver has a shape of a fork or a clip, which is used to clamp on the needle top to move the needle.

Optionally, the device case includes a first case part and a second case part, with the first case part and the second case part being able to move relative to each other but not detached, wherein the second case part houses the needle gadget chamber; when the first case part and the second case part are relatively opened, the needle gadget chamber is exposed and allows the insertion of the needle gadget; after the needle gadget is inserted, the first case part and the second case part are closed to lock the needle gadget inside the chamber for acupuncture treatment.

Optionally, the automatic acupuncture device comprises an electromagnet, which moves a needle driver to push the needle into human body when powered on.

Optionally, the automatic acupuncture device further comprises a rechargeable battery to power the motor or the electromagnet.

According to another aspect of the present invention, a needle gadget used with an automatic acupuncture device is provided, which comprises: a needle tube with a ceiling, a wall and a floor; an acupuncture needle inside the needle tube comprising a needle tip, a needle shaft and a needle top on which a needle driver of an automatic acupuncture device applies force and whole diameter is larger than the needle shaft; a hole on the needle tube ceiling and/or a slit on the needle tube wall, through which the needle driver is able to enter the needle tube and exerts force on the needle top; a needle outlet at the needle tube floor, through which the needle tip and shaft are pushed out of the needle tube and inserted into human body; a needle-holding spring sheathed outside the needle shaft and enclosed inside the needle tube, with one end connecting on the needle tube floor and the other end pressing on the needle top, which is configured as: before the needle gadget is used, the acupuncture needle is pressed toward the needle tube ceiling by the needle-holding spring to prevent the needle tip from exposing to air outside of the needle tube and accidently injuring people; during acupuncture treatment, the needle driver pushes the needle into human body and the needle-holding spring is compressed; after acupuncture treatment, the needle driver removes the force from the needle top, the spring extends and presses the needle back toward the needle tube ceiling.

Optionally, the needle top has an uneven surface and couples with an uneven surface of the needle driver to transmit the rotary motion from the needle driver to the needle, to perform rotating acupuncture manipulation.

Optionally, the diameter of the hole on the needle tube ceiling is smaller than the diameter of the needle top of the acupuncture needle, to prevent the needle from falling out of the needle tube.

Optionally, the diameter of the needle tube floor is larger than that of the rest of the needle tube, and/or the needle tube wall has a bulging column or indented groove to match the shape of the needle gadget chamber, to control the insertion direction of the needle gadget.

Optionally, the needle tube has a protruding stop or an locking notch to get locked when the needle gadget is inserted into the needle gadget chamber, to prevent the needle gadget from falling out of the automatic acupuncture device during acupuncture treatment.

Optionally, the needle gadget chamber opening has a larger diameter than the rest of the chamber, and/or has a bulging column or indented groove on the side to match the groove or column on the needle tube, for the needle gadget insertion direction control.

Optionally, the needle tube floor protrudes into the needle tube in a shape of a column with diameter smaller than the needle-holding spring diameter to allow the spring sitting around it; the outlet diameter of the needle tube is slightly bigger than the needle shaft to allow the needle to pass through, but will not allow the needle to bend during insertion.

Optionally, the needle tube has a ferromagnetic piece and gets attracted to a magnet piece inside the needle gadget chamber after inserted into the chamber, to prevent the needle gadget from falling out of the chamber during acupuncture treatment.

According to another aspect of the present invention, a method to do acupuncture with an automatic acupuncture device is provided. Before the use, the battery of the automatic acupuncture device has enough energy for one acupuncture session, and when in use, the method includes: inserting a needle gadget into the needle gadget chamber of the automatic acupuncture device and locking it inside; attaching the automatic acupuncture device onto body surface; powering on the automatic acupuncture device automatically or manually; running a program stored in a control circuit of the automatic acupuncture device to start the motor or electromagnet, to control the needle driver, to push the acupuncture needle, and/or to perform the rotating acupuncture manipulations; allowing the acupuncture needle to stay in human body for a preset period of time; after the preset period of time, controlling the motor or electromagnet to remove force exerted on the needle top and to allow the needle-holding spring in the needle gadget to pop out the needle from human body, or to exert a pulling force on the needle top to pull the needle out of human body, or to exert a trigger force to remove the needle from human body; after the acupuncture treatment, detaching the automatic acupuncture device from the body, activating the locking mechanism, and releasing the needle gadget from the automatic acupuncture device.

According to the embodiments of the invention, the automatic acupuncture device, the needle gadget being use with the automatic acupuncture device, and the acupuncture method have one or more of the following advantages: 1) automatic; 2) the operation is simple; 3) the automatic acupuncture device and the needle gadget are small and easy to carry; 4) patients can do acupuncture by themselves at any time whenever needed; 5) there is no pain or only slight pain; 6) the needle gadget is disposable, and can be put in or taken out of the automatic acupuncture device detachably, 7) the acupuncture needle is safe: before, during and after the acupuncture, the acupuncture needle is always kept inside the needle tube, and will not be exposed to the air outside of the needle tube, to avoid the needle contamination, accidentally sticking into the people or polluting the environment; 8) it can achieve lifting-thrusting and twisting-rotating acupuncture effect.

The automatic operation of the acupuncture device is achieved through a motor or electromagnet. During operation, the user only needs to insert the needle gadget into the needle gadget chamber of the automatic acupuncture device and attaches the acupuncture device to a specific part of the body through double-sided adhesive tape or a strap. After that, the motor or electromagnet can start to do acupuncture according to a program stored in the control circuit.

BRIEF DESCRIPTION OF THE DRAWINGS

FIG. 2A shows a schematic diagram that the needle gadget has been inserted into the needle gadget chamber, the locking head 197 is pressed in the needle tube locking notch 240, and the needle driver has partially pushed the acupuncture needle out of the needle tube. FIG. 2B is a schematic diagram showing that the locking head 197 is pushed out of the needle gadget chamber when the needle gadget is half inserted or ejected.

FIGS. 2C and 2D differ from FIGS. 2A and 2B in the design of the needle tube locking notch 240 and a protruding column 258.

FIGS. 5A and 5C show a bottom view of the acupuncture device case, and FIGS. 5B and 5D show the inside surface of the bottom part 395 of the automatic acupuncture device case. FIGS. 5A and 5B show that the locking head 380 protrudes into the needle gadget chamber opening, and FIGS. 5C and 5D show that the locking head 380 is pushed out of the needle gadget chamber opening.

FIG. 5E shows a state when the locking head is pressed into the chamber opening. FIG. 5F shows a state when the locking head is pushed out of the chamber opening.

DETAILED DESCRIPTION

The embodiments of the present invention are described below in conjunction with the accompanying drawings.

The inventive ideas of the invention are described as following: the acupuncture needle is pushed into the skin by a mini-motor or electromagnet to achieve the effect of acupuncture; two modes are preferred: 1), the motor moves the needle driver and the needle driver pushes the needle into the human body, which completes the insertion action; the acupuncture needle is ejected out from the human body by a spring attached to the needle, which is compressed during needle insertion; 2), the needle driver is made into a shape of a fork or a clip, which clamps on the needle top and moves the needle to do acupuncture; this type of automatic acupuncture device can both insert and remove needles. Electromagnetic acupuncture uses electromagnet to generate magnetic force and moves the needle through needle driver.

Figure 1:
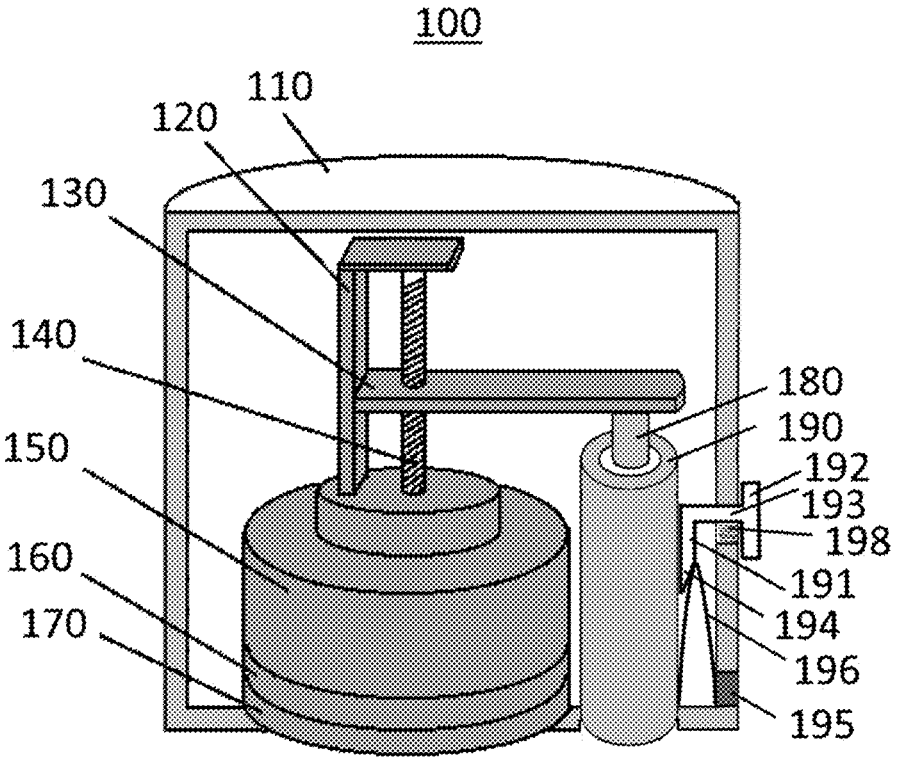
FIG. 1 shows a structural diagram of an automatic acupuncture device 100 according to an embodiment of the present invention.

FIG. 1 shows a structural diagram of an automatic acupuncture device 100 according to an embodiment of the present invention.

As shown in FIG. 1, the automatic acupuncture device includes: a case 110; a motor 150, which is configured to exert force to move a needle driver after powered on; a needle driver 180, which is configured to move linearly under the force of a motor to insert the acupuncture needle in a needle gadget into the human body; the needle gadget includes a needle tube and an acupuncture needle inside the needle tube; and a needle gadget chamber 190, which is configured to house the needle gadget; and a locking-releasing structure 191-198, which is configured to lock the needle gadget inside the needle gadget chamber, so that the needle gadget will not fall out of the needle gadget chamber during acupuncture, and which is also configured to release the needle gadget from the needle gadget chamber after acupuncture treatment.

The motor is preferably a mini-motor and there is a screw rod 140 connected to its shaft. When the mini-motor is powered on, its rotating shaft drives the screw rod to rotate, and the rechargeable battery 160 supplies power to the mini-motor. The rechargeable battery can be charged through USB charging or through wireless charging. If the wireless charging is adopted, a wireless charging receiver should be added to the acupuncture device.

In the embodiment shown in FIG. 1, the automatic acupuncture device also includes a guide rail 120, a screw nut 130, a screw rod 140 connected with the motor shaft, a rechargeable battery 160, and a control circuit 170.

The control circuit 170 controls the device starting, needle insertion, needle removing, needle manipulation and/or user interface displaying. In this example, the automatic acupuncture device uses a rotary motor. The screw rod 140 is coupled with a screw nut 130. The screw nut moves linearly on the screw rod when the screw rod rotates. One end of the screw nut is connected with a needle driver 180, which moves up and down with the screw nut, to insert the acupuncture needle into the skin or allow the removal of the needle. The guide rail 120 makes the screw nut 130 sliding more stably and prevents the screw nut 130 from rotating with the screw rod. The acupuncture device also includes a locking-releasing structure 191-198 for locking and releasing the needle gadget, which will be explained in detail in conjunction with FIG. 2. The whole acupuncture device is enclosed in the case 110. 190 is the top of the chamber for the needle gadget.

Figure 2A:
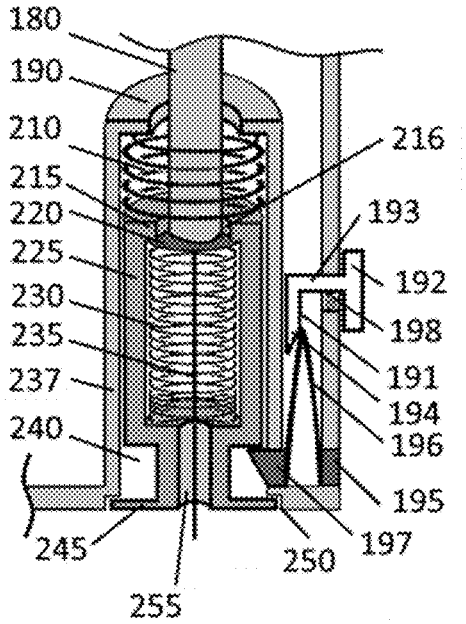
FIGS. 2A and 2B show an internal structure of the needle gadget chamber and a locking-releasing structure that can be used in the automatic acupuncture device in FIG. 1, according to an embodiment of the present invention.
Figure 2B:
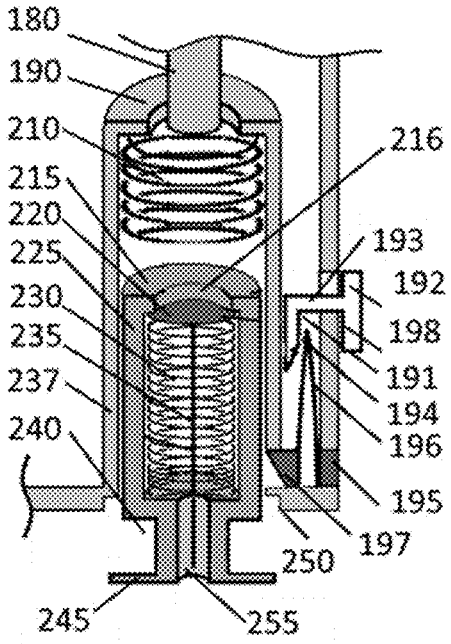

FIGS. 2A and 2B show the internal structure of the needle gadget chamber presented in FIG. 1, and the schematic diagram of the locking-releasing structure. The structure shown in the figure includes a needle driver 180, the needle gadget chamber 190, the spring pusher 194, sliding button 192 for the spring pusher, vertical connecting rod 191 for the spring pusher, horizontal connecting rod 193 for the spring pusher, the flat spring 196, the fixing head 195 for the flat spring, the locking head 197 on the flat spring, the slot spring 198 for the spring pusher, the needle gadget ejector spring 210, needle tube ceiling 215, the hole on the needle tube ceiling 216, the needle top 220, the needle tube wall 225, the needle-holding spring 230, the needle shaft 235, the wall of the needle gadget chamber 237, the needle tube locking notch 240, the needle tube floor 245, the opening of the needle gadget chamber 250 and the needle outlet of the needle tube 255. The needle driver 180 is connected with the screw rod 140 of the motor through the screw nut 130. The driving head 180 drives the needle by pushing the needle top 220. The diameter of the needle top 220 is larger than that of the hole on the needle tube ceiling 216, to prevent the needle from falling out of the needle tube 225.

In FIG. 2A, the acupuncture needle shaft 235, the needle-holding spring 230 and the need top 220 are all connected. During acupuncture, the needle-holding spring 230 is compressed by needle driver 180, and the acupuncture needle shaft 235 is pushed out of the needle tube outlet 255 and inserted into the human body. To withdraw the needle, the needle driver 180 removes the force from the needle top and the compressed needle-holding spring 230 extends and pops the acupuncture needle out of the skin. The design of such a needle gadget keeps the acupuncture needle always with the needle tube. Before and after use, the needle-holding spring always presses the needle top onto the needle tube ceiling, and the needle tip hides inside the needle tube to preventing accidentally sticking people. Because the needle has a tip end and a top end and requires to be inserted in correct direction, in this embodiment, a needle tube floor 245 is designed with larger diameter than the rest of the needle tube 225, to ensure that the needle gadget being inserted into the needle gadget chamber in correct direction. In addition, to lock the needle gadget so that it does not fall out during acupuncture, a locking head 197 and a needle tube locking notch 240 are designed. When pushing the needle gadget in, the locking head is pressed into the locking notch and the needle gadget is locked, and at the same time, the ejector spring 210 is compressed. After acupuncture, the user pushes the sliding button 192 to move the spring pusher 194, which in turn presses on the flat spring 196, and force the locking head 197 out of the locking notch 240. The compressed ejector spring 210 then ejects the needle gadget out. 191 and 913 are the vertical and horizontal connecting rods between the spring pusher 194 and the sliding button 192. The ejector spring 210 is fixed on the top of the needle gadget chamber. 198 is a spring in the slot where the spring pusher 194 moves. The fixing head 195 fixes the flat spring 196 on wall 237 of the acupuncture device case.

FIG. 2B is the schematic diagram of the needle gadget chamber when the needle gadget is ejected by the ejector spring 210. At this time, the locking head 197 is pushed out of the locking notch and the needle gadget chamber.

Figure 2C:
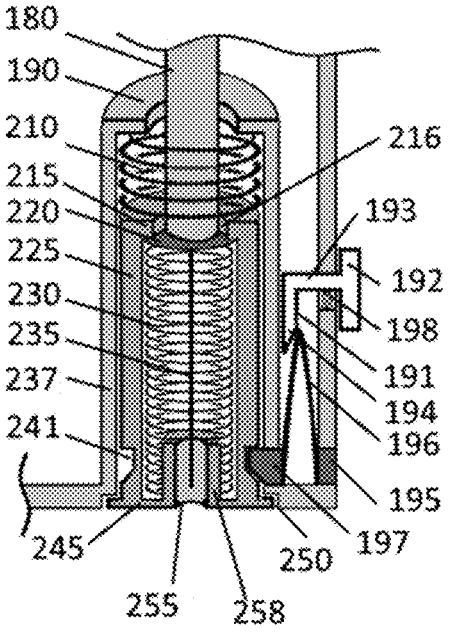
FIGS. 2C and 2D show another internal design of the needle gadget chamber and a locking-releasing structure that can be used in the automatic acupuncture device in FIG. 1, according to an embodiment of the invention.
Figure 2D:
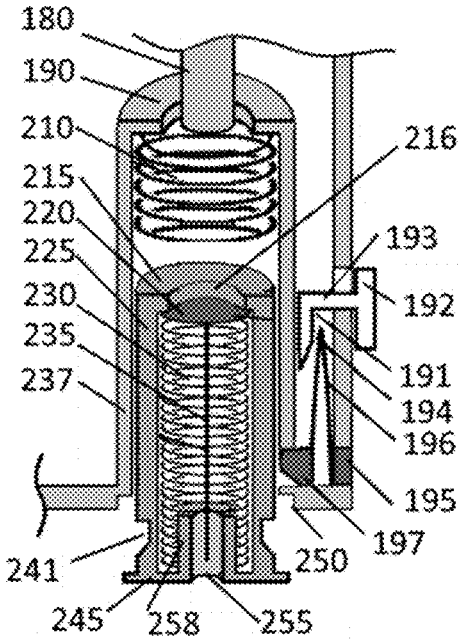

FIG. 2C and FIG. 2D show another schematic diagram of the needle gadget, the needle gadget chamber, and the locking-releasing structure according to an embodiment of the invention. They are similar to FIGS. 2A and 2B, except the following two differences: 1) the locking notch 241 does not protrude into the inner space of the needle tube, but only slightly cuts into the needle tube wall; and 2) the needle tube floor protrudes into the needle tube in a shape of a column 258 with a diameter smaller than the needle-holding spring and the needle outlet slightly larger than the needle shaft, which has two main advantages: 1) stabilize the needle-holding spring, 2) prevent the bending of acupuncture needle during insertion.

Figure 3A:
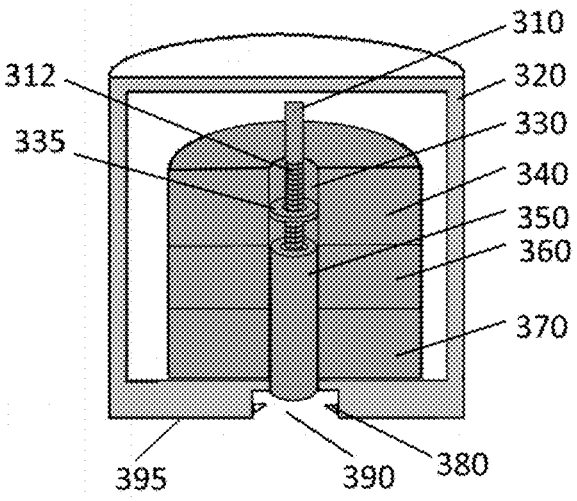
FIG. 3A shows a schematic design of an automatic acupuncture device according to an embodiment of the present invention.
Figure 3B:
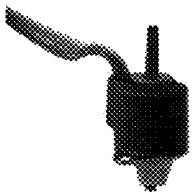
FIG. 3B and FIG. 3C show pictures of a real motor whose motor shaft moves linearly. The motor shaft in FIG. 3B is in the high position, and the motor shaft in FIG. 3C is in the low position.
Figure 3C:
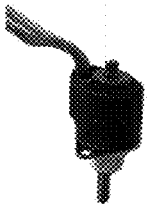

FIG. 3 shows a schematic diagram of another automatic acupuncture device according to an embodiment of the invention, including linear motor 340, motor shaft 310 with thread 312, screw nut 335 fixed inside the motor. The motor shaft rotates in the screw nut to generate linear motion. The automatic acupuncture device also includes an case 320, a needle gadget chamber 350, a rechargeable battery 360, a control circuit 370, an opening of the needle gadget chamber 390, locking heads 380 and the bottom part of the case 395. This design uses a linear motor. The motor shaft and the needle driver connecting with the motor shaft move linearly and push the needle to do acupuncture. FIGS. 3B and 3C show an example of a real linear motor. FIG. 3B shows the motor with the motor shaft at a higher position, and FIG. 3C shows the motor with the motor shaft at a lower position.

Figure 4A:
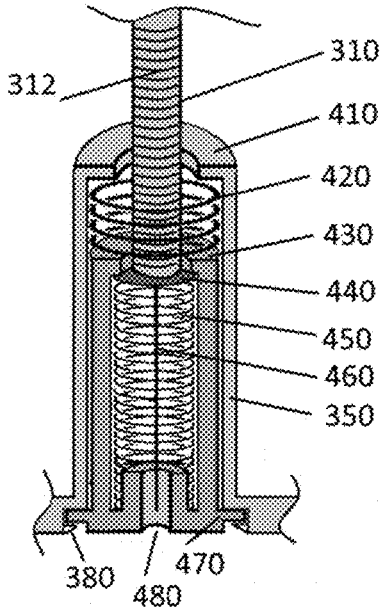
FIG. 4 show internal structures of a needle gadget chamber (FIG. 4A), a needle gadget (FIG. 4B), a needle driver connected with the motor shaft (FIG. 4C) and an acupuncture needle and a needle-holding spring (FIG. 4D), that can be used in the acupuncture device in FIG. 3, according to embodiments of the invention.
Figure 4B:
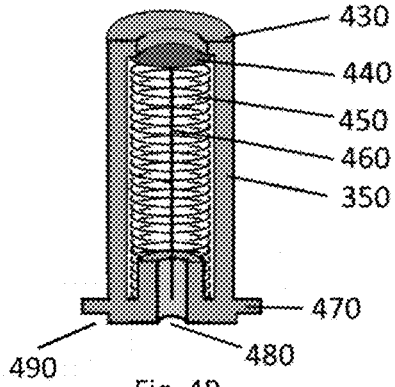
Figure 4C:
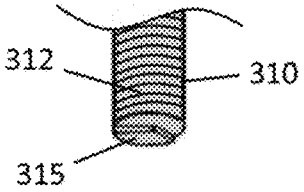
Figure 4D:
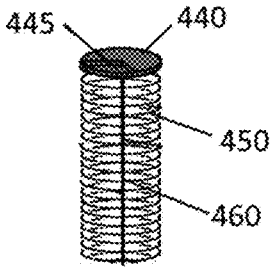

FIG. 4A-4D show detail schematic diagrams of the needle gadget chamber presented in FIG. 3, including the needle gadget chamber (FIG. 4A), the needle gadget (FIG. 4B), the needle driver (FIG. 4C), and the acupuncture needle (FIG. 4D). The components shown in the figures include a motor shaft 310, threads on the shaft 312, an uneven surface 315 of needle driver, needle top 440, uneven surface 445 of the needle top, the needle gadget chamber side wall 350, the needle gadget chamber ceiling 410, ejector spring 420, the needle tube ceiling 430, the needle tube floor 470, the indent on the tube floor 490 and the needle outlet 480. As shown in FIG. 4D, the acupuncture needle includes a needle top 440, a needle shaft 460, and a needle-holding spring 450, an uneven surface 445 on the needle top 440, which matches with the uneven surface 315 on the needle driver in FIG. 4C, and transmits the rotary motion from the needle driver to the needle to perform rotating acupuncture manipulation. FIG. 4B is a needle gadget composed of an acupuncture needle and a needle tube. The needle tip is always hidden inside the needle tube by the needle-holding spring before or after the needle gadget is used, to avoid accidentally sticking people's skin. The diameter of the hole on the needle tube ceiling 430 is smaller than that of the needle top 440 to prevent the needle from falling out. The diameter of the needle-holding spring 450 is only a little smaller than that of the needle tube, which allows the needle-holding spring fit into the needle tube to prevent the spring from bending during compression. The hole on the needle gadget chamber ceiling is for the needle driver to enter the needle tube. During acupuncture, the needle driver pushes the acupuncture needle into the human body and at the same time, compresses the ejector spring. At the end of the acupuncture treatment, the needle driver removes the force exerted on the needle top and the compressed needle-holding spring extends to pop the needle out of the body. After the acupuncture, the ejector spring 420 ejects the needle gadget from the needle gadget chamber when the locking head is released from the needle tube locking notch and unlock the needle gadget.

Figure 5A:
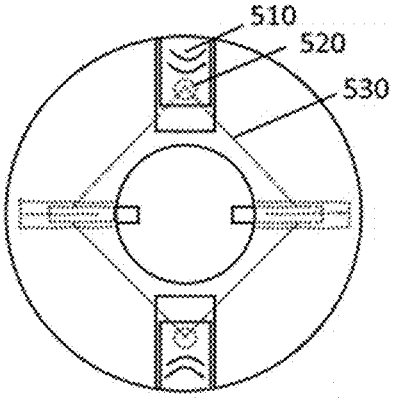
FIGS. 5A-5D show a schematic diagram of the working principle of a locking head 380 that is used in FIG. 3, according to an embodiment of the invention.
Figure 5B:
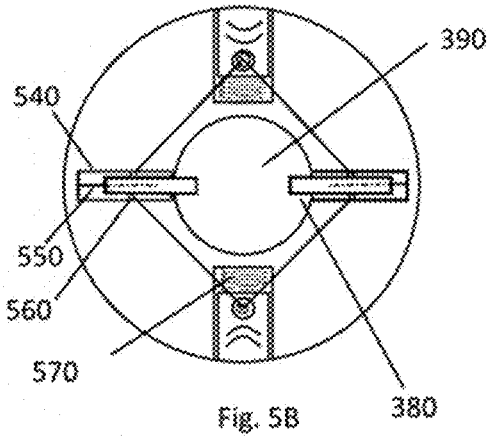
Figure 5C:
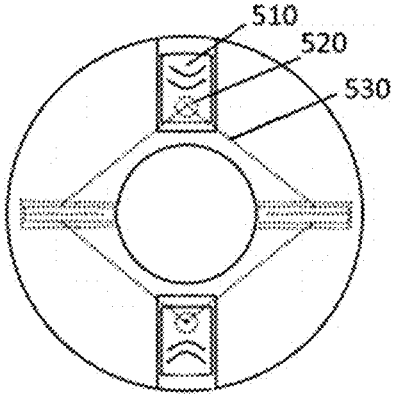
Figure 5D:
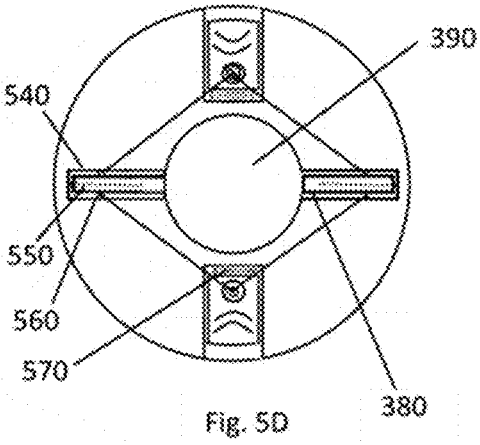

FIGS. 5A to 5B show a schematic diagram of another locking mechanism for the needle gadget according to another embodiment of the invention. FIGS. 5A and 5C show the bottom view of the automatic acupuncture device, and FIGS. 5B and 5D show the inside surface of the bottom piece of the automatic acupuncture device case, including push plates 510, push rods 530, connectors on the push plate 520 to connect with the push rods, locking heads 380 (also marked in FIG. 3) protruding into the needle gadget chamber opening 390 at resting state, locking head chambers 540, sliding rods 550 around which the locking head moves, connector rings 560 on the locking heads to connect with the push rods, and push plate springs 570. FIGS. 5A and 5B show the schematic diagram in which the locking heads 380 protrude into the chamber opening 390, and FIGS. 5C and 5D show the schematic diagram in which the locking heads are completely pushed into locking head chambers 540. When pushing a needle gadget into the needle gadget chamber opening 390, the locking heads 380 are pushed out of the chambers by the needle tube floor 470 (shown in FIG. 4). Meanwhile, the push plate springs 570 are compressed under the force transmitted through the push rods 530. When the indent 490 at the needle tube floor 470 are facing the locking heads 380, the locking heads are rebounded again under the action of the push plate springs 570, are pressed into the indent 490 and the needle gadget is locked. The locking heads 380 move on the sliding rods 550, which is fixed in the locking head chambers 540. The push rods 530 are connected to the locking heads through connector rings 560, and the push rods can rotate on the rings. The push rods 530 are connected to the push plates 510 through the connectors 520, and the push rods can also rotate on the connectors.

Figure 5E:
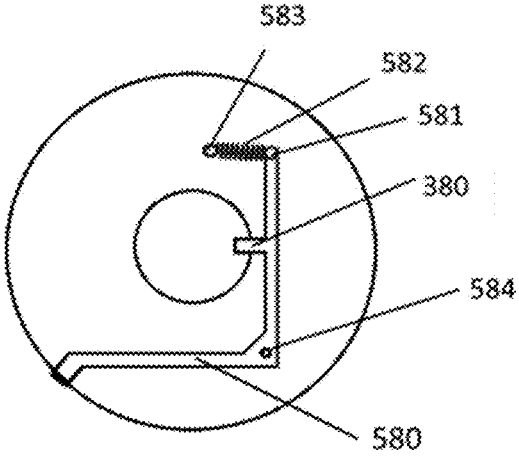
FIGS. 5E-5F show another schematic diagram of the working principle of the locking head 380 used in FIG. 3. In this design, the locking head 380 is only used on one side of the needle gadget chamber opening.
Figure 5F:
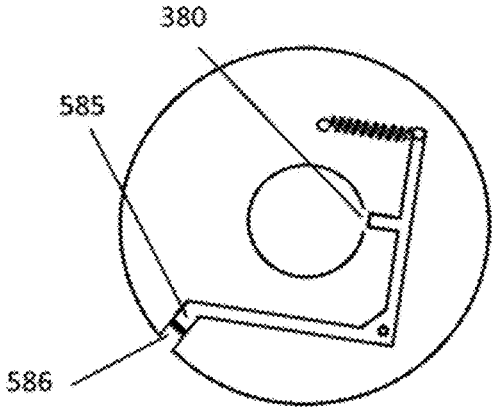

FIGS. 5E-5F show another schematic diagram of the working principle of the locking head 380 used in FIG. 3. In this design, the locking head 380 is only used on one side of the needle gadget chamber opening. The locking-releasing structure comprises a rotatable frame 580, a locking head 380 on the frame that protrudes into the chamber opening at resting state, a frame spring 582, a connector for the frame 584 to connect to the case, connectors (581, 583) to connect the spring to the case and the frame, a press button 585 connected with the frame to move the locking head, a button chamber 586. The needle gadget is configured to have a locking notch on the needle tube. When pushing the needle gadget into the needle gadget chamber, the needle tube pushes the locking head out of the needle gadget chamber. Meanwhile, the frame is rotated, and the frame spring is lengthened until the locking head is facing the locking notch on the needle tube. At this time, the locking head is pulled back into the locking notch of needle tube by the frame spring to lock the needle gadget inside the chamber. FIG. 5E shows a state when the locking head is present in the chamber opening. FIG. 5F shows a state when the locking head is pulled out of the chamber.

Figure 6:
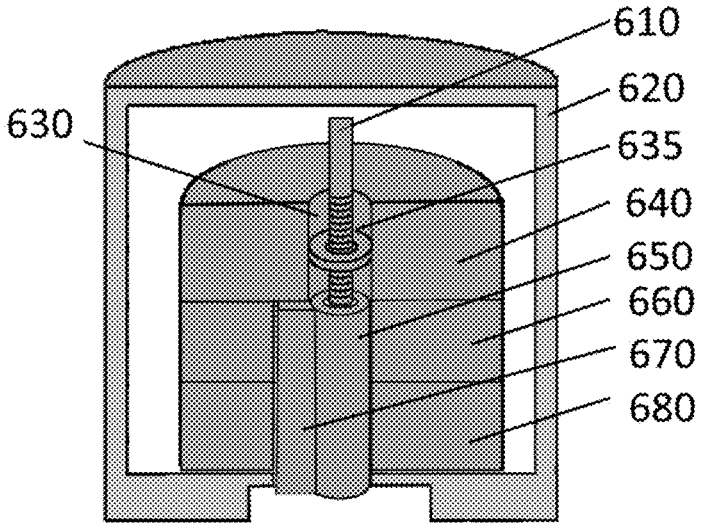
FIG. 6 shows a schematic design of another automatic acupuncture device according to an embodiment of the present invention.

FIG. 6 shows a schematic design of another automatic acupuncture device according to an embodiment of the present invention. This diagram is similar to FIG. 3, except that a different locking-releasing structure is used with a self-locking chamber 670, but without locking head 380.

Figure 7A:
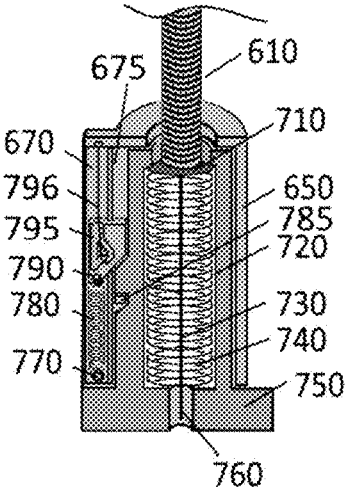
FIGS. 7A-7F show the detailed design of the needle gadget chamber 670 in FIG. 6.
Figure 7B:
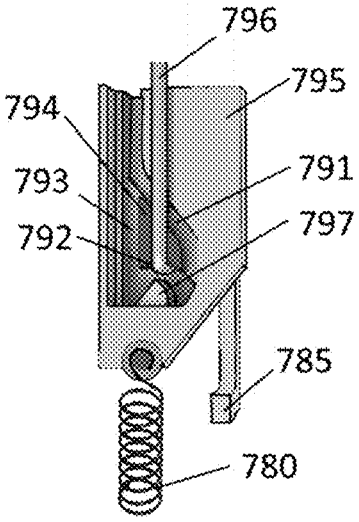
Figure 7C:
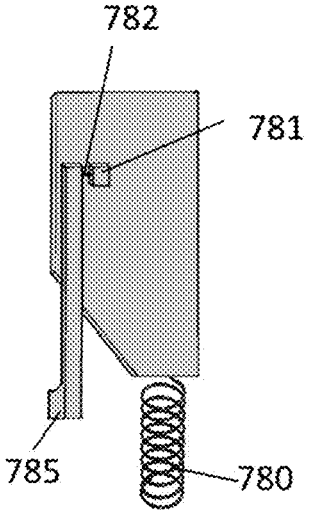
Figure 7D:
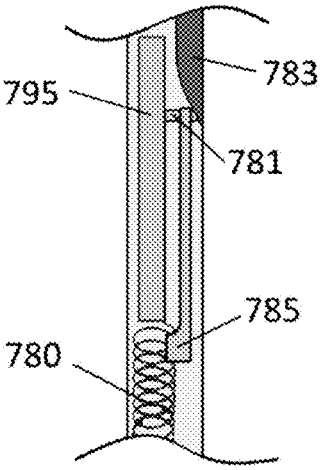
Figure 7E:
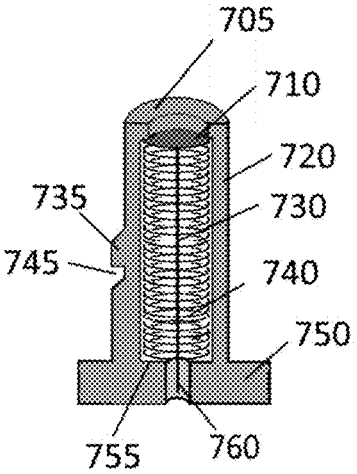
Figure 7F:
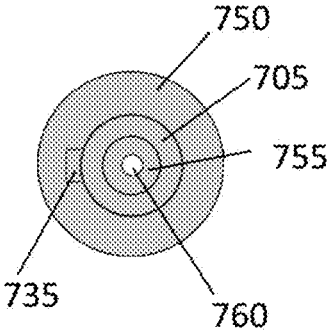

FIG. 7A shows a detailed design of the self-locking chamber 670 presented in FIG. 6 and the needle gadget 720, according to an embodiment of the present invention. The design includes a sliding plate 795, a sliding rod 675 for the sliding plate to slide up and down, a pull rod 796, a hook 792 at the tip of the pull rod, a spring 780 connecting the sliding plate and the device case, connectors (770, 790) for the two ends of the spring, a locking head 785, connectors (781, 782) connecting the locking head to the sliding plate. The sliding plate 795 comprises an elevating groove 791, a falling groove 793, a notch island 794, a deep notch 792 on the notch island for the hook to hook on, and a guiding peninsula 797. The elevating groove 791 becomes shallower along the way towards the notch island. The notch 792 is deeper than the neighboring elevating groove. When pushing a needle gadget in for the first time, the pushing edge 735 of the needle tube pushes the sliding plate upward along the sliding rod and drives the locking head 785 moving upwards as well. At the same time, the pull rod is pushed to the elevating groove. When the needle gadget is pushed to the end of the needle gadget chamber, the pull rod reaches the end of the elevating groove and then suddenly falls into the deep notch 792 on the notch island, gets hooked there. At this moment, the force pushing the needle gadget can be removed, the needle gadget is locked and can be used for acupuncture. When the needle gadget is pushed for the second time, the hook will be released from the deep notch and enter the falling groove 793 when bump into the guiding peninsula 797. Afterwards, the spring 780 pulls the sliding plate toward the bottom of the acupuncture device, the locking head 785 breaks from the locking notch 745 on the needle tube and the needle gadget is pushed out of the needle gadget chamber on the pushing edge 735 by the sliding plate, and taken out by the user. FIG. 7B is an enlarged view of the sliding plate and its accessories presented in FIG. 7A. FIG. 7C is the back view of FIG. 7B, showing the connection structure between the locking head and the sliding plate. FIG. 7D is the side view of FIG. 7B, which shows how the locking head is pushed up by slope 783 and leans towards the sliding plate during the pushing in process. FIG. 7E shows a needle gadget comprising a needle tube and a needle. The needle tube floor 750 restrict the insertion direction for the needle gadget. The pushing edge 735 pushes the sliding plate 795 when pushing the needle gadget into the needle gadget chamber. The needle gadget also includes the needle tube ceiling 705, the needle tube floor 750, the inner surface of the needle tube floor 755, the needle outlet 760, the needle-holding spring 740, the needle shaft 730, the needle tube 720, and the needle top 710. FIG. 7F is the top view of the needle tube without acupuncture needle, which mainly shows the structural relationship between the pushing edge 735 and the needle tube ceiling 705.

Figure 8:
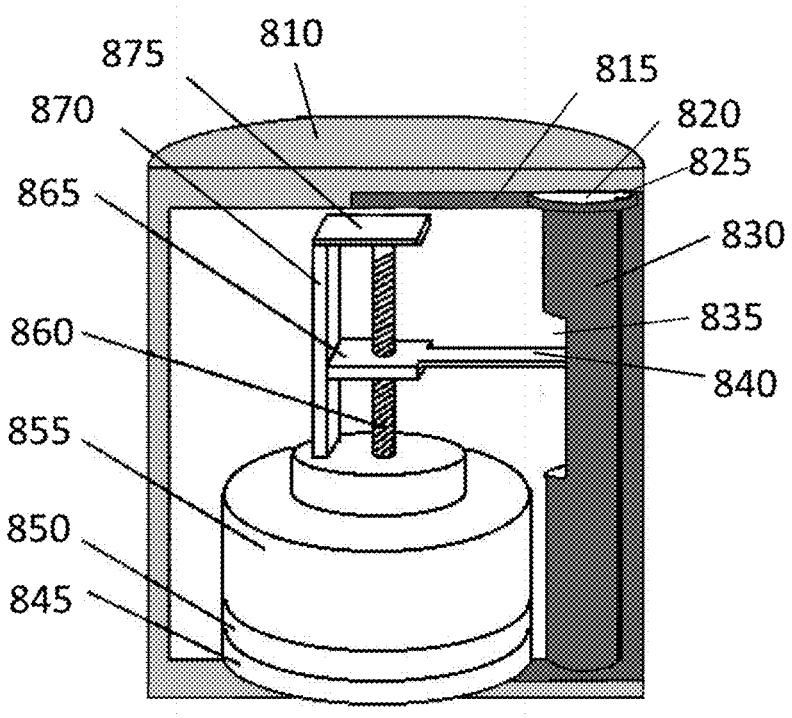
FIG. 8 shows a schematic design of another automatic acupuncture device according to an embodiment of the present invention.

FIG. 8 shows a schematic design of another automatic acupuncture device according to an embodiment of the present invention. This design includes: cases 810 and 815, a needle gadget chamber opening 820, a chamber groove 825 to restrict the needle gadget insertion direction, a needle gadget chamber 830, a chamber slit 835 for needle driver to enter the chamber, a needle driver 840, a control circuit board 845, a rechargeable battery 850, a motor 855, a screw rod 860 connected with the motor shaft, a screw nut 865, a guide rail 870, and an end plate 875.

Figure 9A:
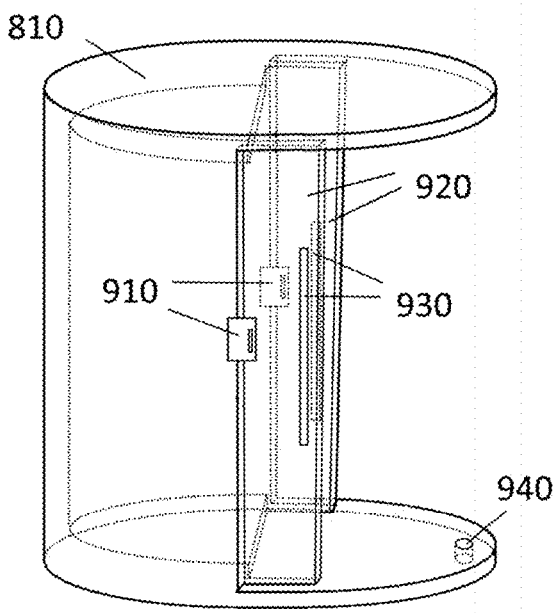
FIG. 9 shows a detailed design of the case in FIG. 8 according to an embodiment of the present invention.
Figure 9B:
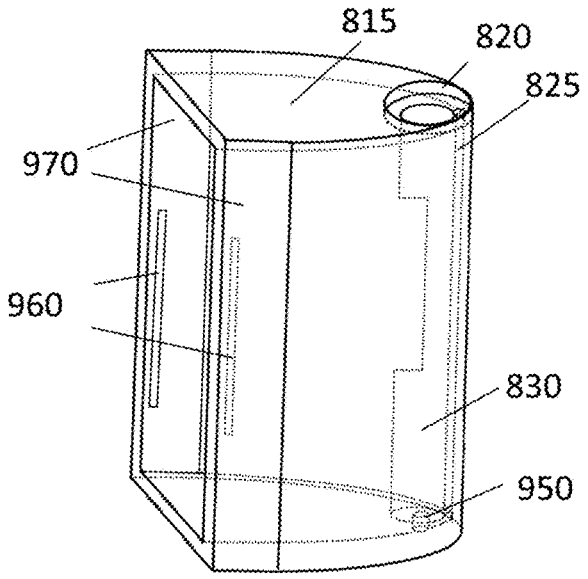
Figure 10A:
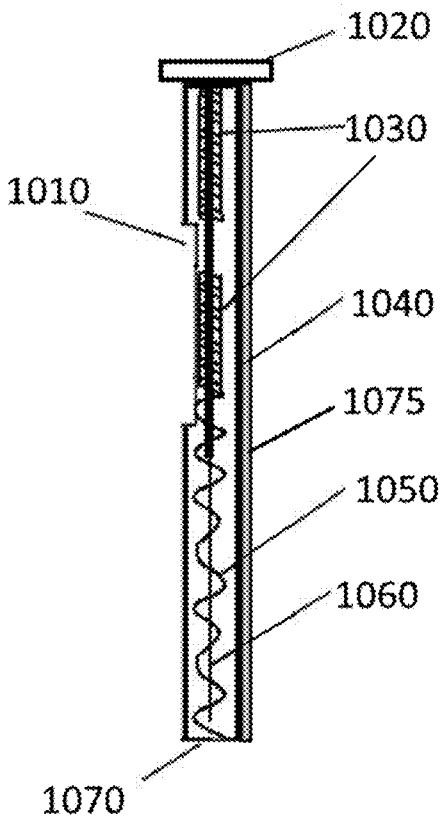
FIGS. 10A-10D show a needle gadget used with the automatic acupuncture device in FIG. 8, according to an embodiment of the present invention.
Figure 10B:
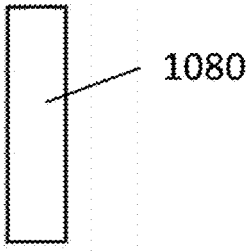
Figure 10C:
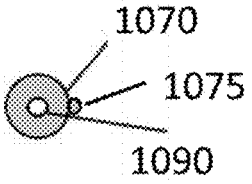
Figure 10D:
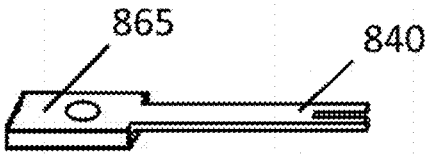

FIG. 9 shows a detailed design of the cases in FIG. 8 according to an embodiment of the present invention. The cases consist of two parts. The case 810 is for a motor, a control circuit, and a rechargeable battery. The case 815 is for the needle gadget chamber 830. The case 810 and 815 can slide relative to each other but cannot be detached. When the clamping strips 930 and 960 encounter, it is the maximum distance that the two cases can be opened, which makes the needle gadget chamber opening 820 exposed and allows the needle gadget being inserted. During acupuncture treatment, the cases 810 and 815 are closed, and the clamping plate 910 clamps on the clamping strip 960 to prevent the two case parts from being opened. At this time, the plates 920 and 970 overlap and the needle outlets 940 and 950 are aligned, allowing the acupuncture needle being pushed out for acupuncture. The diameter of the chamber opening 820 is slightly larger than the rest of the chamber wall, and there is a long groove 825 on the side of the chamber. Together they limit the insertion direction of the needle gadget.

FIGS. 10A-10D show the needle gadget used with the automatic acupuncture device presented in FIG. 8. The needle gadget includes a needle tube floor 1070, a needle outlet 1090, a bulging column 1075 to limit insertion orientation, a needle 1060, a needle-holding spring 1050, a needle tube 1040, a needle top 1030, a needle tube ceiling 1020, a needle tube slit 1010 for a needle driver to enter the needle tube. Before the use of the needle gadget, the needle tube slit is generally sealed by a single-sided tape 1080 to prevent dust from entering the needle tube and contaminating the needle. The needle driver 840 is connected to the screw rod 860 by a screw nut 865, which moves up and down with the rotation of the screw rod. The end of the needle driver 840 has a fork shape to clamp on the needle top 1030, to drive the needle up and down.

Figure 11A:
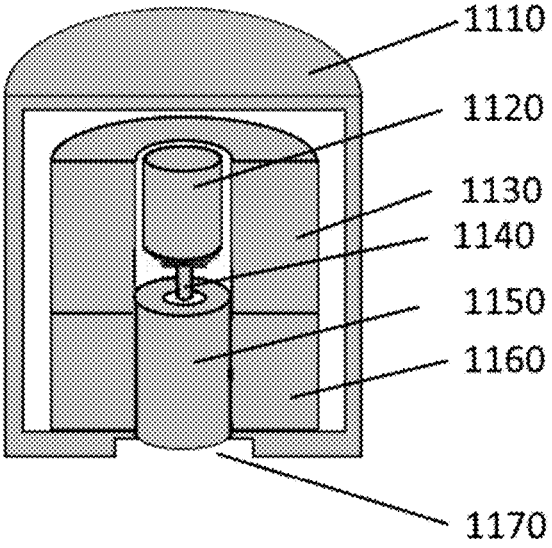
FIG. 11A shows a schematic design of an automatic acupuncture device driven by an electromagnet, according to an embodiment of the present invention.
Figure 11B:
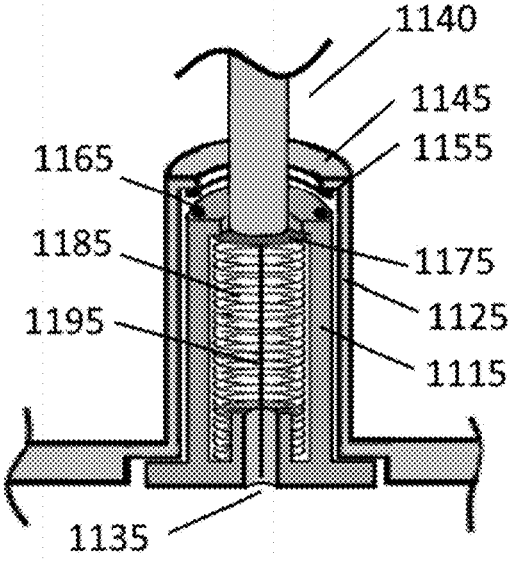
FIG. 11B shows the internal structure of the needle gadget chamber and a needle gadget.

FIG. 11A shows a design scheme of an automatic acupuncture device driven by an electromagnet according to an embodiment of the present invention. In FIG. 11A, 1110 is the case of the automatic acupuncture device, 1130 is the battery, 1120 is an electromagnet, one end of which is connected with a needle driver 1140, 1150 is the needle gadget chamber, 1160 is the control circuit, and 1170 is the chamber opening. FIG. 11B shows the needle gadget chamber and the needle gadget. 1145 is the top wall of the needle gadget chamber, 1155 is a magnetic material fixed inside of 1145. 1165 is a ferromagnetic material fixed on the top of the needle tube. 1155 and 1165 form the locking-releasing structure for the automatic acupuncture device. When the needle gadget is inserted into the needle gadget chamber, it is attracted by 1155 through 1165, and is locked inside the needle gadget chamber. To remove the needle gadget, a small bump can be designed on the needle tube floor to push out the needle gadget. 1115 is the needle tube wall, 1125 is the side wall of the needle gadget chamber, 1175 is the needle top, 1195 is the needle shaft, 1185 is the needle-holding spring, and 1135 is the needle outlet at the needle tube floor. When powered on, the needle driver is pushed away from the electromagnet to push acupuncture needle into the skin. To remove needle, the electromagnet is powered off, and the needle driver will return to its original position. With the design of a needle gadget being similar to the previous designs, the needle can be pulled out through its own needle-holding spring, once the needle driver removes the force on the needle top.

Figure 12A:
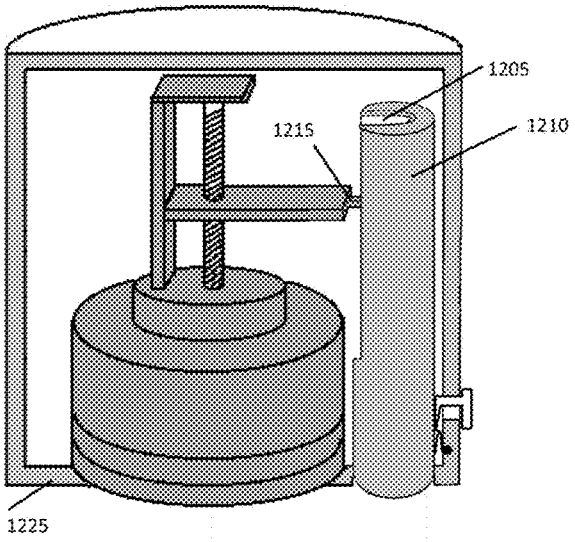
FIG. 12A shows another design of an automatic acupuncture device and a needle gadget according to an embodiment of the present invention.
Figure 12B:
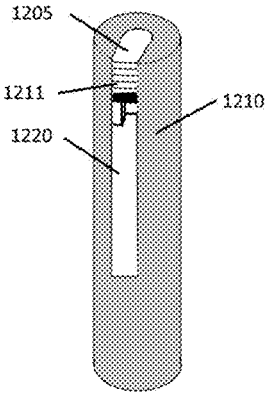
FIG. 12B shows a schematic diagram of the needle gadget chamber.
Figure 12C:
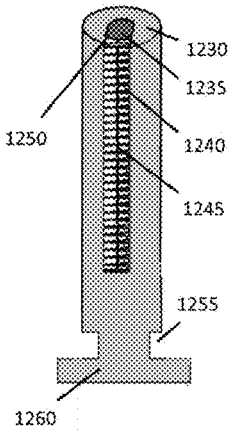
FIG. 12C is the schematic diagram of needle gadget.
Figure 12D:
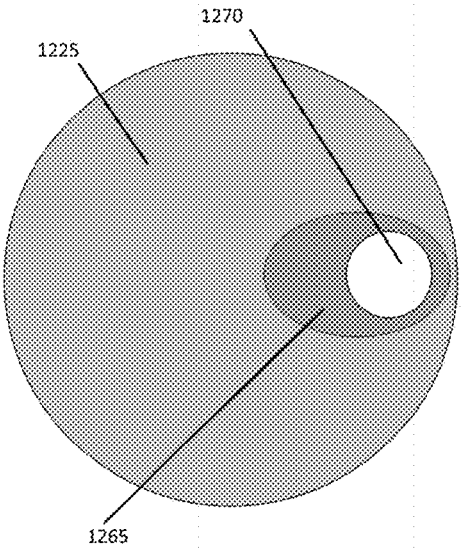
FIG. 12D is the schematic diagram of the bottom of the automatic acupuncture device.
Figure 12E:
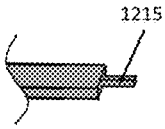
FIG. 12E is the needle driver 1215.
Figure 12F:
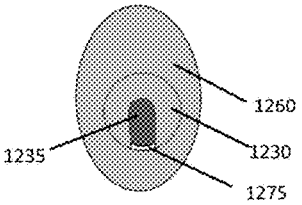
FIG. 12F is the top view of FIG. 12C, FIG. 12G. is an ejector spring.
Figure 12G:
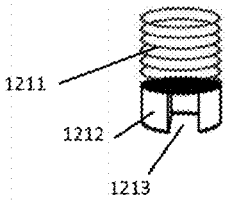

FIG. 12A shows another design of the automatic acupuncture device and a needle gadget according to another embodiment of the invention. The motor part is similar to that in FIG. 8. The differences are the needle driver 1215, the needle gadget chamber 1210, the needle gadget and the case. There are openings on the tops and slits on the sides of the needle tube and needle gadget chamber, which allow the needle driver to enter the needle tube from the top and move down along the slit, instead of entering the needle tube from the side in a horizontal way, as presented in FIG. 8. The device case is a whole piece instead of two pieces (as shown in FIG. 9). FIG. 12B shows the schematic diagram of the needle gadget chamber, in which 1205 is the opening on the top of needle gadget chamber, 1220 is the slit on the side wall 1210 of the needle gadget chamber. 1211 is an ejector spring with a block attached to the bottom (to be described in detail in FIG. 12G). FIG. 12C is the schematic diagram of a needle gadget. 1230 is the needle tube ceiling, 1235 is the needle top, 1240 is the needle-holding spring, 1245 is the needle shaft, 1255 is the locking notch on the needle tube, 1260 is the needle tube floor, 1250 is the openings on the needle tube, designed to let the needle driver enter the needle tube. FIG. 12D is the bottom view of the automatic acupuncture device. 1225 is the case, 1270 is the needle gadget chamber, 1265 is the needle gadget chamber opening. The fact that 1270 is not exactly in the center of 1265 is to define the insertion direction of the needle gadget. FIG. 12E shows a needle driver 1215, and FIG. 12F shows the top view of FIG. 12C, showing the shape of needle tube floor 1260 that matches the needle gadget chamber opening 1265. FIG. 12G shows the ejector spring 1211 in a larger view with a block 1212 attached to the bottom. The block has a notch 1213 where the needle driver stays. Before acupuncture, the needle driver is at the top of the block notch 1213. When the needle gadget is inserted into the needle gadget chamber, it pushes the block 1212, compress the ejector spring 1211 and the needle driver relatively moves down the notch. When the needle gadget is fully in, the needle driver will be at the bottom of the block notch 1213. With the needle gadget inserted in defined direction, the opening on the needle tube ceiling now is right below the needle driver, allowing the needle driver to enter the needle tube and push the acupuncture needle into the human body. The locking-releasing structure for this design can adopt any locking-releasing structure presented in other places of this invention.

Figure 13A:
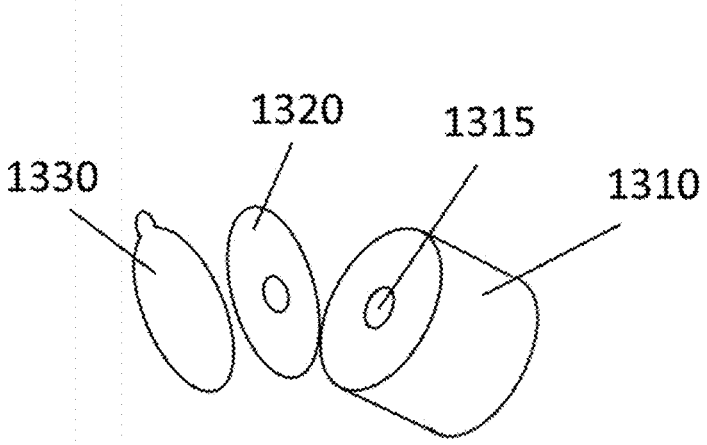
FIGS. 13A and 13B are schematic diagrams showing how an automatic acupuncture device attaches on the skin according to an embodiment of the present invention. 1320 is double-sided adhesive tape and 1330 is release paper of double-sided adhesive tape. There is a small hole in the center of the double-sided adhesive tape that matches with the needle outlet 1315 at the bottom of the automatic acupuncture device 1310. During acupuncture, the needle passes through the outlet of the acupuncture device and the hole of the double-sided adhesive tape and inserts into the skin.
Figure 13B:
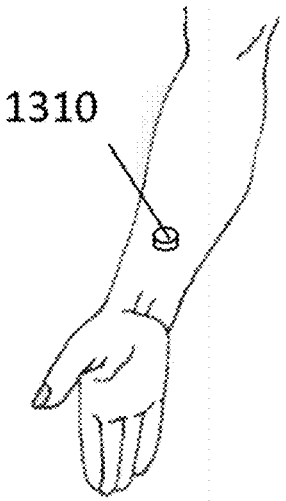

FIGS. 13A-13B show a scenario diagram of an automatic acupuncture device attached on the skin according to an embodiment of the present invention. There is a needle outlet 1315 at the bottom of the automatic acupuncture device 1310. When in use, one side of a double-sided adhesive tape 1320 sticks to the automatic acupuncture device and the other side sticks to the human body, as shown in FIG. 13B. The center of the double-side tape also has a hole in the center, match the needle outlet. Release paper 1330 is used on the double-sided tape before using.

Figure 14A:
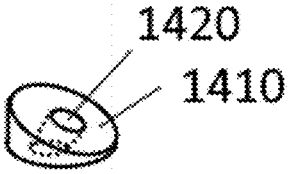
FIGS. 14A and 14B show accessory designs of an automatic acupuncture device according to an embodiment of the present invention.
Figure 14B:
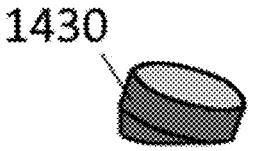

FIGS. 14A and 14B show an accessory of the automatic acupuncture device according to the embodiment of the invention, which is used to facilitate the acupuncture needle to insert into the body at different angles. FIG. 14A shows a cylinder with a slope at one end. The two planes of the cylinder are covered with tape, the inclined plane sticks to the skin, and the opposite side 1410 adheres to the automatic acupuncture device. The hole in the center 1420 is for the needle insertion. FIG. 14B is another design. This design adds a wall 1430 on the design of FIG. 14A, which allows the automatic acupuncture device to be placed right in the middle of the outer wall, for easier alignment.

Various embodiments of the invention have been described above, which are illustrative, not exhaustive, and are not limited to the disclosed embodiments. Without departing from the scope and spirit of the described embodiments, many modifications and changes are obvious to those of ordinary skill in the art. Therefore, the protection scope of the invention shall be subject to the protection scope of the claim.

The invention claimed is:

1. A wearable automatic acupuncture device, comprising:

a case;

a motor or electromagnet that is configured to provide force to move a needle driver linearly after powered on;

the needle driver, the needle driver configured to move linearly under the force of the motor or electromagnet to push an acupuncture needle in a needle gadget into a human body;

the needle gadget, the needle gadget comprising a needle tube with a ceiling, a wall and a floor, the acupuncture needle inside the needle tube, the acupuncture needle comprising a needle tip, a needle shaft and a needle top on which the needle driver of the automatic acupuncture device applies a force and whose diameter is larger than the needle shaft, a hole on the needle tube ceiling and/or a slit on the needle tube wall, through which the needle driver is able to enter the needle tube and exerts the force on the needle top, a needle outlet at the needle tube floor, through which the needle tip and the needle shaft are pushed out of the needle tube and inserted into the human body, a needle-holding spring sheathed outside the needle shaft and enclosed inside the needle tube, with one end connecting on the needle tube floor and the other end pressing on the needle top, which is configured as: before the needle gadget is used, the acupuncture needle is pressed toward the needle tube ceiling by the needle-holding spring to prevent the needle tip from exposing to air outside of the needle tube and accidently injuring people; during acupuncture treatment, when the needle driver pushes the needle into the human body, the needle-holding spring is compressed; after acupuncture treatment, the needle driver removes the force from the needle top, the needle-holding spring extends and presses the needle back toward the needle tube ceiling;

a needle gadget chamber that is configured to house the needle gadget, allowing the needle gadget being put into or taken out of the needle gadget chamber detachably; and a locking-releasing structure that is configured to lock the needle gadget in the needle gadget chamber so that the needle gadget will not fall out of the needle gadget chamber during acupuncture treatment, and that is also configured to release the needle gadget from the needle gadget chamber after acupuncture treatment.

2. The automatic acupuncture device according to claim 1, further comprising a control circuit, which is configured to control device starting, needle insertion, needle manipulation, needle removing, and/or user interface displaying.

3. The automatic acupuncture device according to claim 1, wherein the motor is configured as a rotary motor and its motor shaft rotates when powered on, wherein the automatic acupuncture device further comprises a transmission system that converts a rotary motion to a linear motion.

4. The automatic acupuncture device according to claim 3, the transmission system comprising:

a screw rod connected to the motor shaft;

a guide rail mounted on a motor shell;

a screw nut around the screw rod that slides along the guide rail when the screw rod rotates, to move the needle driver linearly.

5. The automatic acupuncture device according to claim 1, wherein the motor is configured as a linear motor, and is connected with the needle driver on its motor shaft, when powered on, the motor shaft and the needle driver move linearly.

6. The automatic acupuncture device according to claim 5, wherein the motor shaft and therefore the needle driver move linearly as well as rotate, which drive the needle to move linearly and to rotate through an uneven surface coupling between the needle driver and the needle top, to perform rotating acupuncture manipulation.

7. The automatic acupuncture device according to claim 1, wherein the needle driver is a vertical pole, and the needle tube ceiling of the needle gadget has a hole to allow the needle driver vertically entering into the needle tube, getting in touch with the needle top and pushing the needle.

8. The automatic acupuncture device according to claim 1, wherein the needle driver is a horizontal bar, the needle tube ceiling of the needle gadget has a hole with a diameter wider than the needle driver, the needle tube wall has a slit with a width wider than the needle driver, the slit and the hole are connected, and when in use, the needle driver enters the needle tube through the hole and the slit, moves down through the slit on the needle tube wall and touches the needle top to push the needle.

9. The automatic acupuncture device according to claim 1, wherein the needle driver is a horizontal bar, the needle tube wall of the needle gadget has a slit with a width wider than the needle driver, and when in use, the needle driver enters the needle tube through the slit on the needle tube wall, makes contact with the needle top to move the needle.

10. The automatic acupuncture device according to claim 1, further comprising an ejector spring in the needle gadget chamber, which is configured as following:

when the needle gadget is pushed into the needle gadget chamber, the ejector spring is compressed, and the locking-releasing structure locks the needle gadget in the chamber;

when the locking-releasing structure unlocks the needle gadget, the ejector spring extends and pushes out the needle gadget.

11. The automatic acupuncture device according to claim 1, wherein the locking-releasing structure comprises a locking head, and the needle tube of the needle gadget has a locking notch, and when the needle gadget is pushed into the needle gadget chamber and the locking head is pressed into the locking notch of the needle tube, the needle gadget is locked in the chamber.

12. The automatic acupuncture device according to claim 1, wherein the locking-releasing structure is a magnetic piece inside the needle gadget chamber, which attracts ferromagnetic materials attached on the needle tube to lock the needle gadget.

13. The automatic acupuncture device according to claim 1, wherein the needle gadget chamber has an opening for the needle gadget to enter the chamber, the locking-releasing structure comprises push plates, push rods, connectors on the push plates to connect with the push rods, locking heads that protrude into the chamber opening at resting state, sliding rods around which the locking heads moves, connector rings on the locking heads to connect with the push rods, push plate springs, wherein the needle gadget is configured to have a locking notch on the needle tube, and the chamber, the locking-releasing structure and the needle gadget work together as following: when pushing the needle gadget into the chamber opening, the locking heads are pushed out of the chamber opening; meanwhile the push plate springs are compressed until the locking heads are facing the locking notch and pushed back to the chamber opening by the compressed push plate springs to lock the needle gadget inside the chamber.

14. The automatic acupuncture device according to claim 1, wherein the needle gadget chamber has an opening for the needle gadget to enter the chamber, the locking-releasing structure comprises a rotatable frame, a locking head on the rotatable frame that protrudes into the chamber opening at resting state, a frame spring, connectors to connect the frame spring and the frame to the case of the automatic acupuncture device, a press button connected with the frame to rotate the frame and move the locking head, the needle gadget is configured to have a locking notch on the needle tube, and the chamber, the locking-releasing structure and the needle gadget work together as following: when pushing the needle gadget into the needle gadget chamber, the locking head will be pushed out of the chamber opening; at the same time, the rotatable frame is moved and the frame spring is stretched until the locking head is facing the locking notch on the needle tube; the locking head is pulled back into the chamber opening by the frame spring and pressed in the locking notch on the needle tube to lock the needle gadget inside the chamber.

15. The automatic acupuncture device according to claim 1, wherein the locking-releasing structure comprises a sliding plate, a pull rod, a hook at the tip of a pull pole, a sliding rod on which the sliding plate slides, a spring connecting the sliding plate and the device case, connectors to fix the two ends of the spring, a locking head, connectors to connect the locking head to the sliding plate, an elevating groove and a falling groove on the sliding plate, a notch island, a notch on the notch island for the hook to hook on, a guiding peninsula, wherein the elevating groove becomes shallower towards the notch island, and the notch becomes deeper again at the end of the elevating groove, and the locking-releasing structure works as following:

when the needle gadget is pushed into the needle gadget chamber for the first time, the sliding plate and the locking head are pushed in; the hook slides towards the notch island along the elevating groove; when the needle gadget reaches a bottom of the needle gadget chamber, the hook reaches the end of the elevating groove, falls into the notch on the notch island and gets hooked on the notch; at the same time, the locking head is pushed into a locking notch on the needle tube, locks the needle gadget in the needle gadget chamber and the spring is stretched;

when the pushing force is released from the needle gadget, the needle gadget will stay in the needle gadget chamber for acupuncture treatment;

when needle gadget is pushed for a second time after acupuncture treatment, the hook is released from the notch and guided into the falling groove; at the same time, the stretched spring pulls the sliding plate back towards the bottom of the acupuncture device, releases the locking head from the locking notch, and pulls the needle gadget out for user to take out completely.

16. The automatic acupuncture device according to claim 1, wherein the needle driver has a shape of a fork or a clip, which is used to clamp on the needle top to move the needle.

17. The automatic acupuncture device according to claim 1, wherein the case includes a first case part and a second case part, with the first case part and the second case part being able to move relative to each other but not detached, wherein the second case part houses the needle gadget chamber; when the first case part and the second case part are relatively opened, the needle gadget chamber is exposed and allows the needle gadget to be inserted; after the needle gadget is inserted, the first case part and the second case part are closed and the needle gadget is locked inside the needle gadget chamber for acupuncture treatment.

18. The automatic acupuncture device according to claim 1, comprising the electromagnet, which moves the needle driver to push the needle into the human body when powered on.

19. The automatic acupuncture device according to claim 1, further comprising a rechargeable battery to power the motor or the electromagnet.

* * * * *